United States Patent [19]

Suzuki

[11] Patent Number: 4,910,553

[45] Date of Patent: Mar. 20, 1990

[54] COPYING APPARATUS WITH SHEET NUMBER MAGNIFICATION DISPLAY

[75] Inventor: Seiichi Suzuki, Hachioji, Japan

[73] Assignee: Konishiroku Photo Industry Co., Ltd., Tokyo, Japan

[21] Appl. No.: 270,408

[22] Filed: Nov. 7, 1988

Related U.S. Application Data

[63] Continuation of Ser. No. 18,050, Feb. 24, 1987, abandoned.

[30] Foreign Application Priority Data

Feb. 28, 1986 [JP] Japan ..... 61-43471
Apr. 19, 1986 [JP] Japan ..... 61-90980

[51] Int. Cl.[4] ..... G03G 21/00

[52] U.S. Cl. ..... 355/203; 355/209; 355/204

[58] Field of Search ..... 355/14 C, 14 CU, 14 R, 355/3 R, 55, 56, 59, 206, 204, 203, 209, 208; 340/790, 791, 766, 782, 707, 712, 756, 286 M, 286.01–286.14

[56] References Cited

U.S. PATENT DOCUMENTS 4,441,804 4/1984 Shibazaki et al. ..... 355/14 R
4,619,521 10/1986 Miyamoto ..... 355/14 R
4,764,789 8/1988 Iwaki et al. ..... 355/209
4,792,827 12/1988 Ogura ..... 340/286.13 X
4,839,699 6/1989 Hosaka et al. ..... 355/55
4,847,662 7/1989 Yamada ..... 355/56 X

FOREIGN PATENT DOCUMENTS 0113216 6/1985 Japan ..... 355/56
0135962 7/1985 Japan ..... 355/14 C
0247232 12/1985 Japan ..... 355/56
0615258 1/1986 Japan ..... 355/14 C
0615262 1/1986 Japan ..... 355/14 C

*Primary Examiner*—A. T. Grimley
*Assistant Examiner*—Matthew S. Smith
*Attorney, Agent, or Firm*—Frishauf, Holtz, Goodman & Woodward

[57] ABSTRACT

A copying apparatus includes a ten-key pad for setting sheet number data, a magnification setting key for setting magnification data, a display for selectively indicating the copy number data or the magnification data, and a computer including a CPU, a ROM, and a RAM for causing the display to indicate the magnification data when the magnification setting means is operated and for otherwise causing the display to indicate the sheet number data.

5 Claims, 4 Drawing Sheets

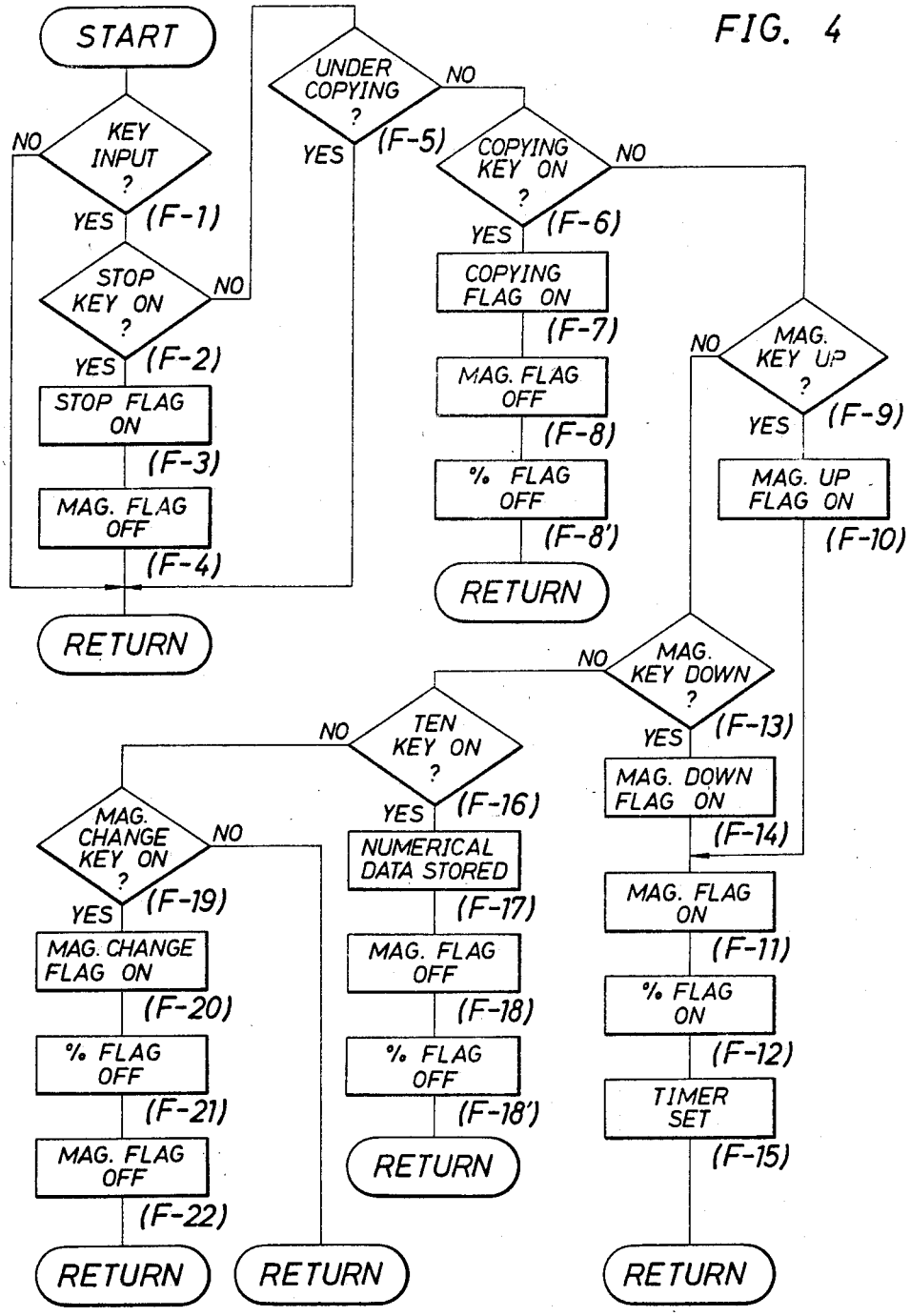
FIG. 4
START
KEY INPUT ?
(F-1)
NO
YES
STOP KEY ON ?
(F-2)
NO
YES
STOP FLAG ON
(F-3)
MAG. FLAG OFF
(F-4)
RETURN
UNDER COPYING ?
(F-5)
NO
YES
COPYING KEY ON ?
(F-6)
NO
YES
COPYING FLAG ON
(F-7)
MAG. FLAG OFF
(F-8)
% FLAG OFF
(F-8')
RETURN
MAG. KEY UP ?
(F-9)
NO
YES
MAG. UP FLAG ON
(F-10)
MAG. KEY DOWN ?
(F-13)
NO
YES
MAG. DOWN FLAG ON
(F-14)
MAG. FLAG ON
(F-11)
% FLAG ON
(F-12)
TIMER SET
(F-15)
RETURN
TEN KEY ON ?
(F-16)
NO
YES
NUMERICAL DATA STORED
(F-17)
MAG. FLAG OFF
(F-18)
% FLAG OFF
(F-18')
RETURN
MAG. CHANGE KEY ON ?
(F-19)
NO
YES
MAG. CHANGE FLAG ON
(F-20)
% FLAG OFF
(F-21)
MAG. FLAG OFF
(F-22)
RETURN
RETURN

COPYING APPARATUS WITH SHEET NUMBER MAGNIFICATION DISPLAY

This application is a continuation of application Ser. No. 18,050, filed Feb. 24, 1987, now abandoned.

BACKGROUND OF THE INVENTION

1. Field of the Invention

The present invention relates to a copying apparatus with a display for selectively indicating sheet number data and magnification data.

2. Description of the Prior Art

A conventional copying apparatus for copying an original image in an equal-size, reduction, or enlargement mode comprises a separate magnification display for indicating a magnification in addition to a sheet number display.

Since the magnification display is arranged separately from the sheet number display, the operation panel is consequently large. These displays and a control means thereof cause an increase in total cost.

In order to eliminate the above disadvantage, a conventional single display is proposed to selectively display sheet number data and magnification data. However, an additional key (e.g., a zoom magnification indication key) is used to selectively indicate sheet number data or magnification data.

According to the arrangement as described above, the additional key must be arranged to indicate a magnification, and complicated operations are required. In addition, the additional key requires additional space and cost.

In a conventional copying apparatus, a mode indicator unit is arranged separately from a display to indicate which data is currently displayed. Therefore, it is difficult for an operator to judge whether the currently indicated content is sheet number data or magnification data, resulting in inconvenience.

SUMMARY OF THE INVENTION

It is a first object of the present invention to provide a copying apparatus capable of automatically switching and indicating sheet number data and magnification data without requiring a manual operation for selecting one of these.

It is a second object of the present invention to provide a copying apparatus wherein indication contents of a display vary according to sheet number data and magnification data.

According to the present invention, a single display selectively indicates magnification data or sheet number data. When an operator sets a desired magnification with a key input means, the magnification is indicated on the display. When a mode other than the magnification mode is set, sheet number data is automatically indicated on the display. An additional magnification indication button need not be arranged, the operation panel is made compact, and total cost can be reduced.

An indicating means such as a % indicator representing a magnification indication mode is arranged integrally with a display or near the display. Even if the display indicates sheet number data, the operator can check the enlargement or reduction copying mode by visually observing the operating state of the indicating means, thereby greatly improving operability.

BRIEF DESCRIPTION OF THE DRAWINGS

FIGS. 4 to 7 are respectively flow charts showing indication operation programs in the copying apparatus shown in FIG. 1.

DETAILED DESCRIPTION OF THE PREFERRED EMBODIMENT

Figure 1:
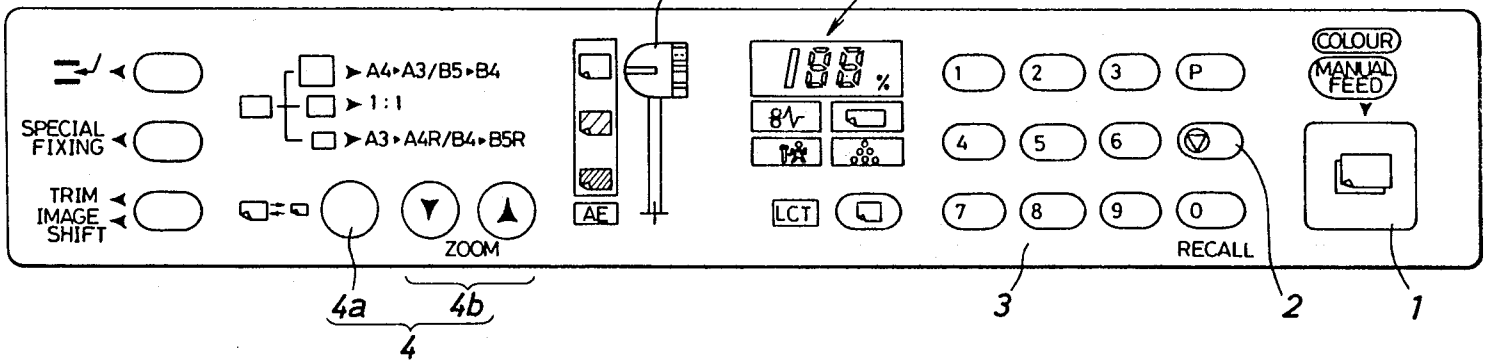
FIG. 1 is a plan view of an operation panel in a copying apparatus according to an embodiment of the present invention.

The present invention will be described in detail below. FIG. 1 shows an operation panel in a copying apparatus according to an embodiment of the present invention. Referring to FIG. 1, reference numeral 1 denotes a copying key; 2, a stop key; and 3, a ten-key pad for entering numerical data such as sheet number data. Reference numeral 4*a* denotes a fixed magnification key for selecting one of the predetermined magnifications; and 4*b*, a zoom magnification key for continuously changing the magnification. The keys 4*a* and 4*b* are called magnification change keys 4. Reference numeral 5 denotes a copy density adjustment key; and 6, a display for selectively indicating sheet number data or magnification data.

Figure 2:
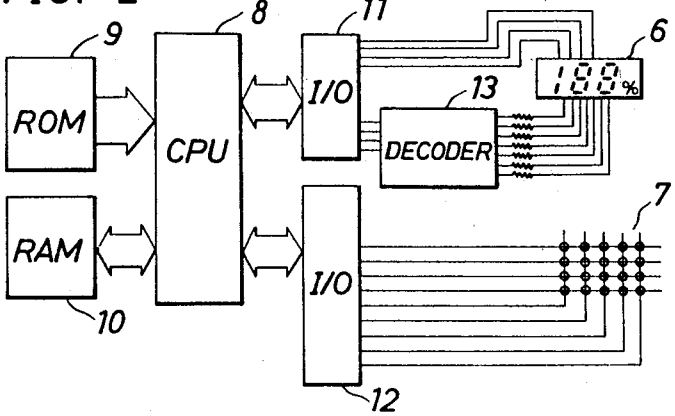
FIG. 2 is a diagram of a control circuit of the operation panel in the copying apparatus shown in FIG. 1.

FIG. 2 is a block diagram of a control circuit for controlling the display 6 and keys 7 constituting a key input means including the above keys 1 to 5. The keys 7 are constituted by a key matrix. The intersections of the rows and columns of the key matrix are connected to the corresponding series circuits each consisting of a nonlocking switch and a reverse blocking diode. Reference numeral 8 denotes a CPU for controlling the overall operation of the control circuit. Operation sequences prestored in a ROM 9 are executed under the control of the CPU 8. Reference numeral 10 denotes a RAM for temporarily storing data and command input from the keys 7 and flag status data thereof. Reference numerals 11 and 12 denote I/O ports; and 13, a decoder for decoding indication data into an indication code.

Figure 3:
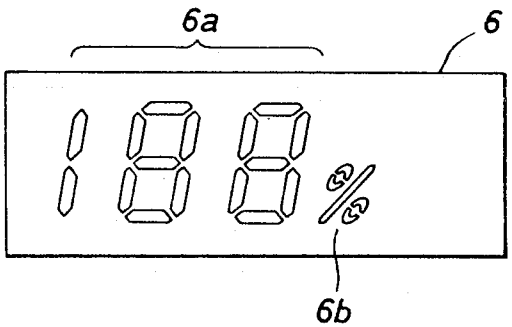
FIG. 3 is a plan view of a display for selectively indicating sheet number data and magnification data.

FIG. 3 shows a mask portion of the display 6. The display 6 consists of a 3-digit numerical value display 6 for indicating a sheet number or magnification and a % indicator 6*b* for magnification indication. Light-emitting diodes are arranged on the lower surface of the mask portion.

Figure 5:
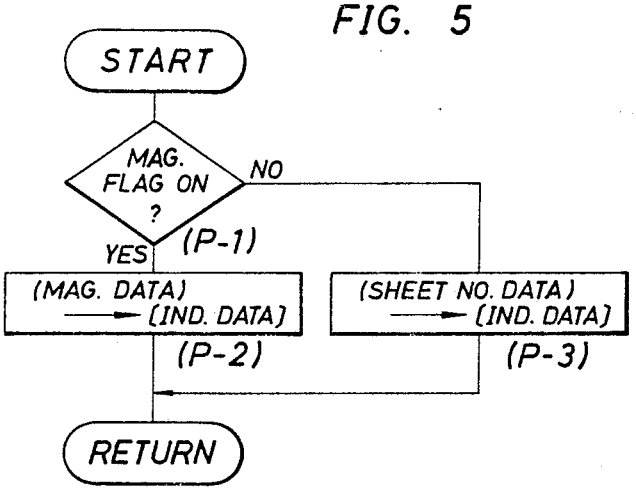
Figure 6:
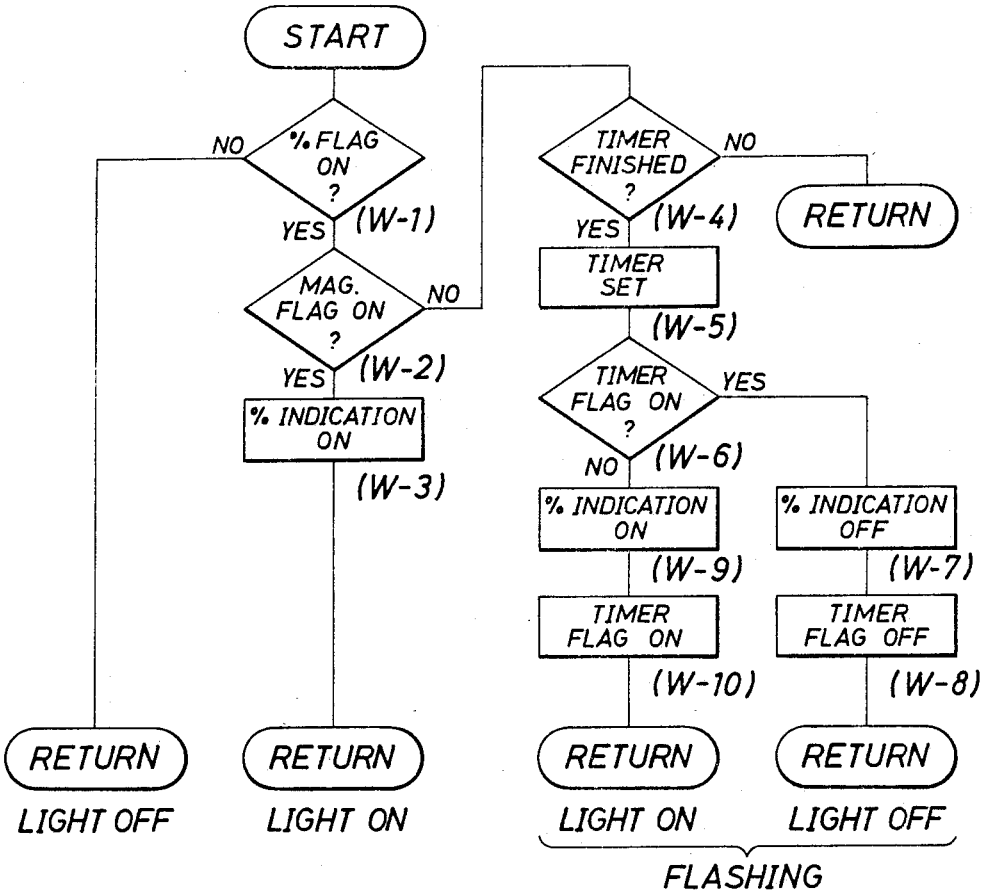

FIGS. 4 to 6 are flow charts showing some (subroutines) of the operation programs written in the ROM 9. Flag ON status is represented by a set state or "1", and flag OFF status is represented by a reset state of "0". In the following flow charts, the "magnification" is represented as "MAG."

Referring to FIG. 4, when a key input is detected (F-1) and the key input is sent from the stop key 2 (F-2), a stop flag is set (F-3), and a MAG. flag (this flag is temporarily stored in the RAM 10 and can be rewritten) is reset (F-4). During copying (F-5), if a key input from a key including the stop key 2 is detected, copying continues. If the key input is sent from the copying key 1 (F-6), a copying flag is set (F-7) and the MAG. flag is reset (F-8). At the same time, the % flag is reset (F-8'). If the key input is sent from the magnification key 4*b* and represents an increase in magnification (F-9), the MAG.UP flag is set (F-10) and the MAG. flag is set (F-11). At the same time, the % flag is set to turn to drive on the % indicator 6b in the display (F-12). Thereafter a timer is set for a predetermined period of time T1. If the key input is sent from the magnification key 4b and represents a decrease in magnification (F-13), the MAG.DOWN flag is set (F-14) and the MAG. flag is also set (F-11). In addition, the % flag is set (F-12). Thereafter, a timer is set for a predetermined period of time T1 (F-15). If the key input is a numerical input entered by the ten-key pad 3 (F-16), numerical data is stored (F-17) and the MAG. flag is reset (F-18). At the same time the % flag is reset (F-18'). If the key input is sent from the fixed magnification key 4a (F-19), the variable MAG. flag is set (F-20). At the same time, the % flag is reset (F-21), and the MAG. flag is reset (F-22).

FIG. 5 shows a selection program of "indication data" indicated on the numerical display 6a of the display 6. The CPU 8 determines whether the MAG. flag is set (P-1). If the MAG. flag is set, magnification data is written as "indication data" in the RAM 10 and is indicated on the display 2a (P-2). However, if the MAG. flag is reset, sheet number data is written as "indication data" in the RAM 10 and is indicated on the display 2a (P-3).

A magnification setting mechanism is driven such that a MAG.UP or MAG.DOWN flag is discriminated by a program (not shown). If the MAG.UP flag is set, the magnification data is incremented by one. However, if the MAG.DOWN flag is set, the magnification data is decremented by one. A magnification setting motor is driven to change the magnification.

FIG. 6 shows a program showing the indication at the % indicator 6b in the display 6. If the % flag is reset (W-1), the % indicator 6b is turned off. In this case, the MAG. flag is reset. The numerical data display 6a in the display 6 indicates the sheet number data. However, if the % flag is set, the lighting state of the % indicator 6b varies according to the logical status of the MAG. flag (W-2).

More specifically, if the MAG. flag is set, the numerical data display 6a indicates the designated magnification, as is apparent from FIG. 5. In this case, the % indicator 6b is turned on to indicate that the current display content is magnification data (W-3).

However, if the operator depresses keys in the ten-key pad excluding the magnification change key, the MAG. flag and the 5 flag are reset, and the numerical display 6a in the display 6 indicates the sheet number data. Then the % indicator 6b is turned off.

Figure 7:
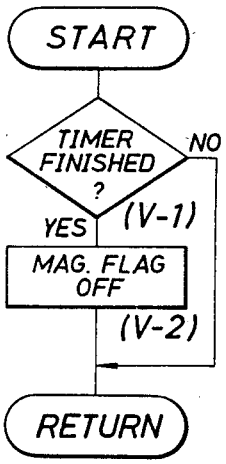

When the magnification change key 4 is depressed, the MAG. flag is set to cause the display to indicate the magnification. However, if no key on the operation panel is depressed when the predetermined period of time has elapsed upon depression of the magnification change key 4, the MAG. flag is reset according to a program shown in FIG. 7 when the predetermined period of time has elapsed (V-1), and the display 6 automatically indicates the sheet number data (V-2). In this state, the copying mode is an enlargement or reduction mode, i.e., a mode excluding the equal-size copying mode. As the % flag is being set, operation advances to step (W-4). In this state, the CPU 8 determines whether the predetermined period of time of the timer has elapsed (W-4). If YES in step W-4, the timer is set (W-5). If the timer flag is set (W-6), the % indicator 6b is turned off (W-7) and the timer flag is reset (W-8). However, if the timer flag is set in step W-6, the % indicator 6b is turned on (W-9) and the timer flag is set (W-10). As a result, the % indicator 6b flashes on the basis of the timer cycle and indicates that the enlargement or reduction mode is set. The flashing cycle is determined by timer data set in the timer, e.g., 0.5 sec.

In the above description, the % indicator 6b is integrally arranged with the display 6. However, the % indicator may be arranged near the display 6.

What is claimed is:

1. A copying apparatus comprising:

sheet number setting means for setting sheet number data;

magnification setting means for setting magnification data;

a display means for selectively displaying one of the sheet number data and the magnification data; and indication selecting means for causing said display means to indicate the magnification data when said magnification setting means is operated and for causing said display means to interrupt display of the magnification data and to indicate the sheet number data upon manual actuation of the sheet number setting means.

2. A copying apparatus according to claim 1, further comprising copying operation mode setting means, said display means including means to change indication of the magnification data into indication of the sheet number data after a predetermined period of time has elapsed when said copying operation mode setting means is not operated within a predetermined period of time after the magnification setting means sets the magnification data.

3. A copying apparatus according to claim 1, further comprising mode indicating means arranged near said display means for distinguishing between a magnification data display mode and a sheet number data display mode.

4. A copying apparatus according to claim 3, wherein said mode indicating means has an operating state at a specific magnification different from an operating state at other magnifications.

5. A copying apparatus according to claim 3, wherein said mode indicating means has different operating states according to the sheet number data and the magnification data.

* * * * *